US012722934B2

(12) United States Patent
LaPoint

(10) Patent No.: US 12,722,934 B2
(45) Date of Patent: Sep. 1, 2026

(54) COILER

(71) Applicant: Brian LaPoint, Chandler, AZ (US)

(72) Inventor: Brian LaPoint, Chandler, AZ (US)

( * ) Notice: Subject to any disclaimer, the term of this patent is extended or adjusted under 35 U.S.C. 154(b) by 399 days.

(21) Appl. No.: 18/555,398

(22) PCT Filed: Apr. 13, 2022

(86) PCT No.: PCT/US2022/071684

§ 371 (c)(1),
(2) Date: Oct. 13, 2023

(87) PCT Pub. No.: WO2022/221839

PCT Pub. Date: Oct. 20, 2022

(65) Prior Publication Data

US 2024/0246792 A1 Jul. 25, 2024

Related U.S. Application Data

(60) Provisional application No. 63/174,412, filed on Apr. 13, 2021.

(51) Int. Cl.
*B65H 75/44* (2006.01)

(52) U.S. Cl.
CPC ..... *B65H 75/4405* (2013.01); *B65H 75/4449* (2013.01); *B65H 2701/34* (2013.01)

(58) Field of Classification Search
USPC ..... 242/613
See application file for complete search history.

(56) References Cited

U.S. PATENT DOCUMENTS 1,179,309 A * 4/1916 Henshaw ..... G03D 13/046 242/602.1
3,402,589 A * 9/1968 Lathom ..... B21C 1/14 72/289

(Continued)

FOREIGN PATENT DOCUMENTS

CN 111731929 10/2020
WO 2012147146 11/2012

(Continued)

OTHER PUBLICATIONS

"International Search Report and Written Opinion", Application No. PCT/US2022/071684, Jul. 18, 2022, 13 pages.

(Continued)

*Primary Examiner* — William A. Rivera
(74) *Attorney, Agent, or Firm* — Colby Nipper PLLC

(57) ABSTRACT

An apparatus is disclosed for implementing a coiler. In an example aspect, the coiler can compactly organize a variety of flexible elements while enabling one portion of the flexible element to remain at a fixed position. Instead of using a rotating reel, the coiler includes a rotating member and a stationary shaft. The rotating member rotates and passes the flexible element to the shaft. In this manner, the rotating member mimics the action of a person manually coiling the flexible element onto the stationary shaft. Because the shaft remains relatively stationary as the flexible element is coiled or uncoiled, the coiled portion of the flexible element also remains relatively stationary. Consequently, the coiler can forego other complicated or expensive interfaces and enable the flexible element to connect directly to a stationary source.

20 Claims, 11 Drawing Sheets

(56) References Cited

U.S. PATENT DOCUMENTS

| | | | | | |
|---|---|---|---|---|---|
| 4,360,715 | A * | 11/1982 | Jamison | B65H 75/4449 | 242/407 |
| 4,589,601 | A * | 5/1986 | Scherer | B65H 75/00 | 242/918 |
| 5,090,647 | A * | 2/1992 | Clarke | A01G 25/00 | 242/615.3 |
| 6,102,319 | A * | 8/2000 | Annabel | B65H 75/148 | 242/125.1 |
| 6,971,605 | B1 | 12/2005 | Martin | | |
| 10,961,080 | B1 * | 3/2021 | Young | B65H 75/4405 | |

FOREIGN PATENT DOCUMENTS

| | | |
|---|---|---|
| WO | 2018192955 | 10/2018 |
| WO | 2022221839 | 10/2022 |

OTHER PUBLICATIONS

"Written Opinion", Application No. PCT/US2022/071684, Feb. 27, 2023, 8 pages.

* cited by examiner

COILER

RELATED APPLICATION(S)

This application is a national stage entry of International Application No. PCT/US2022/071684, filed Apr. 13, 2022, which claims the benefit of U.S. Provisional Application No. 63/174,412, filed Apr. 13, 2021, the disclosures of which are incorporated herein by reference in their entirety.

BACKGROUND

A person can use a variety of different devices with electrical cords. Example devices include power tools, kitchen appliances, and hair-care equipment (e.g., blow dryers, curling irons, or flat irons). In addition to being disorderly, unwound electrical cords can present a safety hazard. A person may accidentally come in contact with the cord and cause the attached device to drop onto the floor. Or a child may be able to pull on the cord to access and operate the device. In some cases, substances can be accidentally spilled onto the cords and result in unsanitary conditions, especially in medical facilities.

SUMMARY

Techniques and apparatuses are described that implement a coiler. The coiler can compactly organize a variety of flexible elements while enabling one portion of a flexible element to remain at a fixed position. In this way, the flexible element can be directly connected to a stationary source while the coiler winds and unwinds the flexible element. This makes it convenient for users to readily use the flexible element.

Instead of using a rotating reel, the coiler includes a rotating member and a stationary shaft. The rotating member rotates and passes the flexible element to the shaft. In this manner, the rotating member mimics the action of a person manually coiling the flexible element onto the shaft. Because the shaft remains relatively stationary as the flexible element is coiled or uncoiled, the coiled portion of the flexible element also remains relatively stationary. Consequently, the coiler can forego other complicated or expensive interfaces and enable the flexible element to connect directly to the stationary source.

Aspects described below include a coiler. The coiler includes a fixed member, a shaft, a rotating member, and a rotation mechanism. The fixed member includes an insertion slot configured to secure a first portion of a flexible element. The shaft has first and second ends. The first end is positioned proximate to the fixed member. The rotating member is positioned proximate to the second end of the shaft and is configured to rotatably move about an axis of rotation. The rotating member includes a guide, which is offset from the axis of rotation. The guide is configured to enable a second portion of the flexible element to pass through the rotating member. The rotation mechanism is configured to rotate the rotating member in a first direction around the axis of rotation to coil the second portion of the flexible element around the shaft.

Aspects described below include an apparatus. The apparatus includes a shaft. The apparatus also includes fixed means for securing a first portion of a flexible element. The apparatus additionally includes rotating means for coiling a second portion of the flexible element around the shaft as the shaft as the shaft and the fixed means remain relatively stationary compared to the rotating means.

Aspects described below include a system. The system includes at least one flexible element and a coiler.

Aspects described below also include a method performed by a coiler. The method includes securing a first portion of a flexible element to a fixed member of the coiler. The method also includes rotating a rotating member of the coiler in a first direction around an axis of rotation as the fixed member and a shaft of the coiler remain relatively stationary. The shaft is positioned between the fixed member and the rotating member. The method additionally includes passing a second portion of the flexible element through the rotating member. The method further includes coiling the second portion of the flexible element around the shaft.

BRIEF DESCRIPTION OF DRAWINGS

Apparatuses for and techniques implementing a coiler are described with reference to the following drawings. The same numbers are used throughout the drawings to reference like features and components.

DETAILED DESCRIPTION

Figure 1:
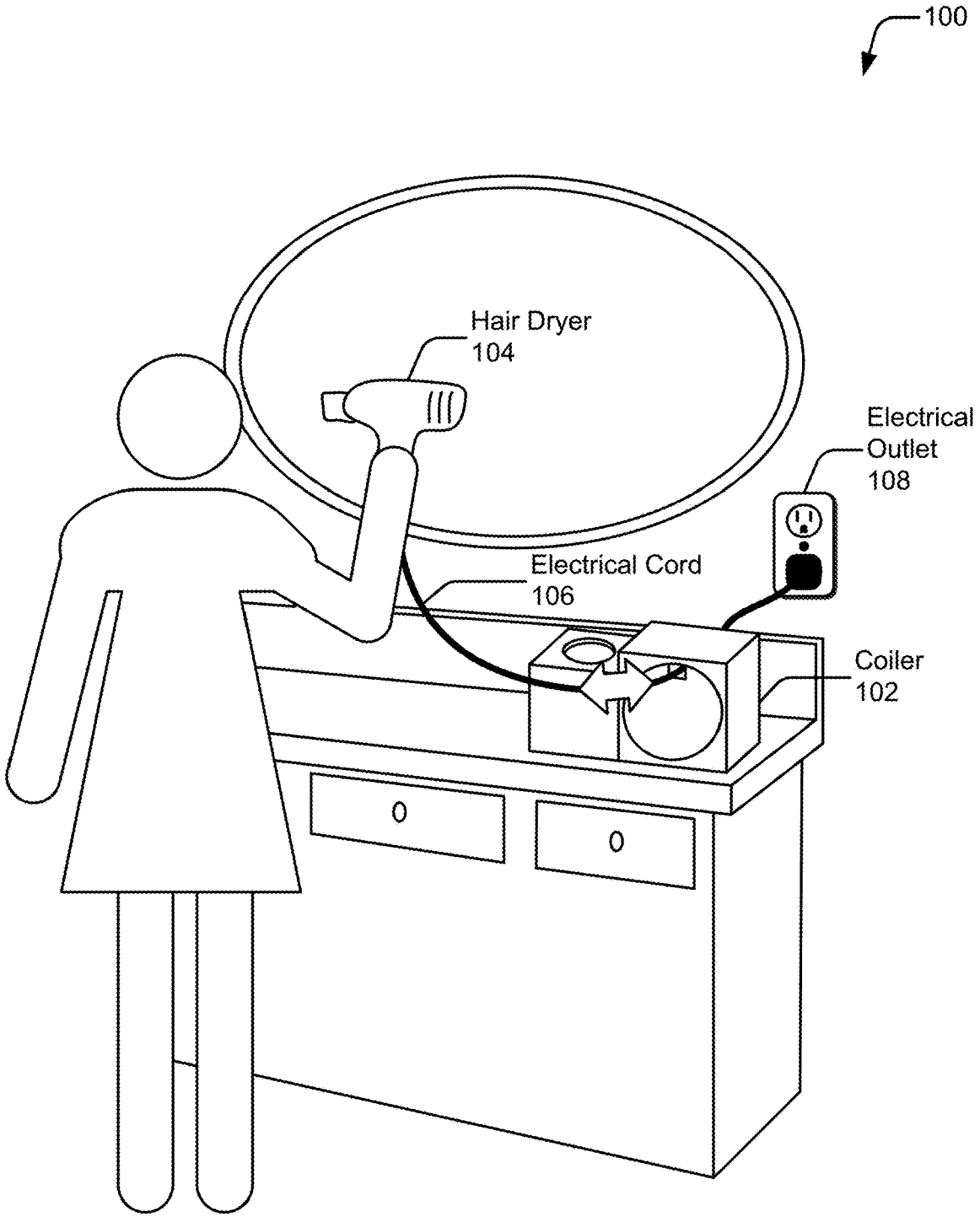
FIG. 1 illustrates an example environment in which a coiler can be implemented.

A person can use a variety of different devices with electrical cords. Example devices include power tools, kitchen appliances, and hair-care equipment (e.g., blow dryers, curling irons, or flat irons). In addition to being disorderly, unwound electrical cords can present a safety hazard. A person may accidentally come in contact with the cord and cause the attached device to drop onto the floor. Or a child may be able to pull on the cord to access and operate the device. In some cases, substances can be accidentally spilled onto the cords and result in unsanitary conditions, especially in medical facilities.

To address this problem, some techniques use a winding system. The winding system spins a reel to wind or unwind a given material, such as an electrical cord or a water hose. A portion of the material that is unwound is aligned approximately parallel to the direction of rotation. As the reel spins, the coiled material spins, which makes it complicated to attach the coiled material to a stationary source, such as an electrical outlet or a water spigot.

To enable the material to be operably coupled to a stationary source, some winding systems include an interface. The interface enables the material to be "indirectly" connected to the stationary source while the material rotates around the reel. One such interface includes a wiper system. The wiper system enables an electrical cord that is wound around the reel to be connected to an electrical outlet. In particular, the wiper system includes internal wiring, which connects the electrical contacts of the electrical cord on the rotating reel to an intermediate electrical cord that connects to the power source. In addition to increasing a cost and complexity of the winding system, the wiper system may have voltage or amperage limitations. As such, the wiper system may not support some electrically-powered devices. If the user is unaware of these limitations, the user may accidentally use the winding system on a device that is not supported by the wiper system. Consequently, the mismatch between the electrical device and the wiper system can damage the electrical device, damage the wiper system, or potentially start a fire.

In contrast, this document describes techniques and devices that implement a coiler. The coiler can compactly organize a variety of flexible elements while enabling one portion of a flexible element to remain at a fixed position. In this way, the flexible element can be "directly" connected to a stationary source (e.g., without an interface such as the wiper system) while the coiler winds and unwinds the flexible element. This makes it convenient for users to readily use the flexible element.

Instead of using a rotating reel, the coiler includes a rotating member and a stationary shaft. The rotating member rotates and passes the flexible element to the shaft. In this manner, the rotating member mimics the action of a person manually coiling the flexible element onto the shaft. Because the shaft remains relatively stationary as the flexible element is coiled or uncoiled, the coiled portion of the flexible element also remains relatively stationary. Consequently, the coiler can forego other complicated or expensive interfaces and enable the flexible element to connect directly to the stationary source.

FIG. 1 illustrates an example environment 100 in which a coiler 102 can operate. In the environment 100, a user operates a hair dryer 104. The hair dryer 104 includes an electrical cord 106, which is plugged into an electrical outlet 108. When not in use, the user can haphazardly store the hair dryer 104 on a counter. However, this can create a disorderly mess or make it challenging to keep the hair dryer 104 out of reach of small children. Alternatively, the user can unplug the hair dryer 104 from the electrical outlet and store the hair dryer 104 in a drawer. However, this can present an daily inconvenience to the user as the user continuously plugs and unplugs the electrical cord 106 from the electrical outlet 108.

To address these problems, the coiler 102 can coil and uncoil the electrical cord 106 while enabling the electrical cord 106 to be attached to the electrical outlet 108. In this way, the coiler 102 can neatly organize the electrical cord 106 within a small area and keep the electrical cord 106 out of the way of small children or accidental spills when the hair dryer 104 is not in use. In some implementations, the coiler 102 can include a stand to store the hair dryer 104. The coiler 102 can coil and uncoil a variety of different materials. As such, the coiler 102 has many applications in a home environment as well as a variety of different industries, as further described with respect to FIG. 2.

Figure 2:
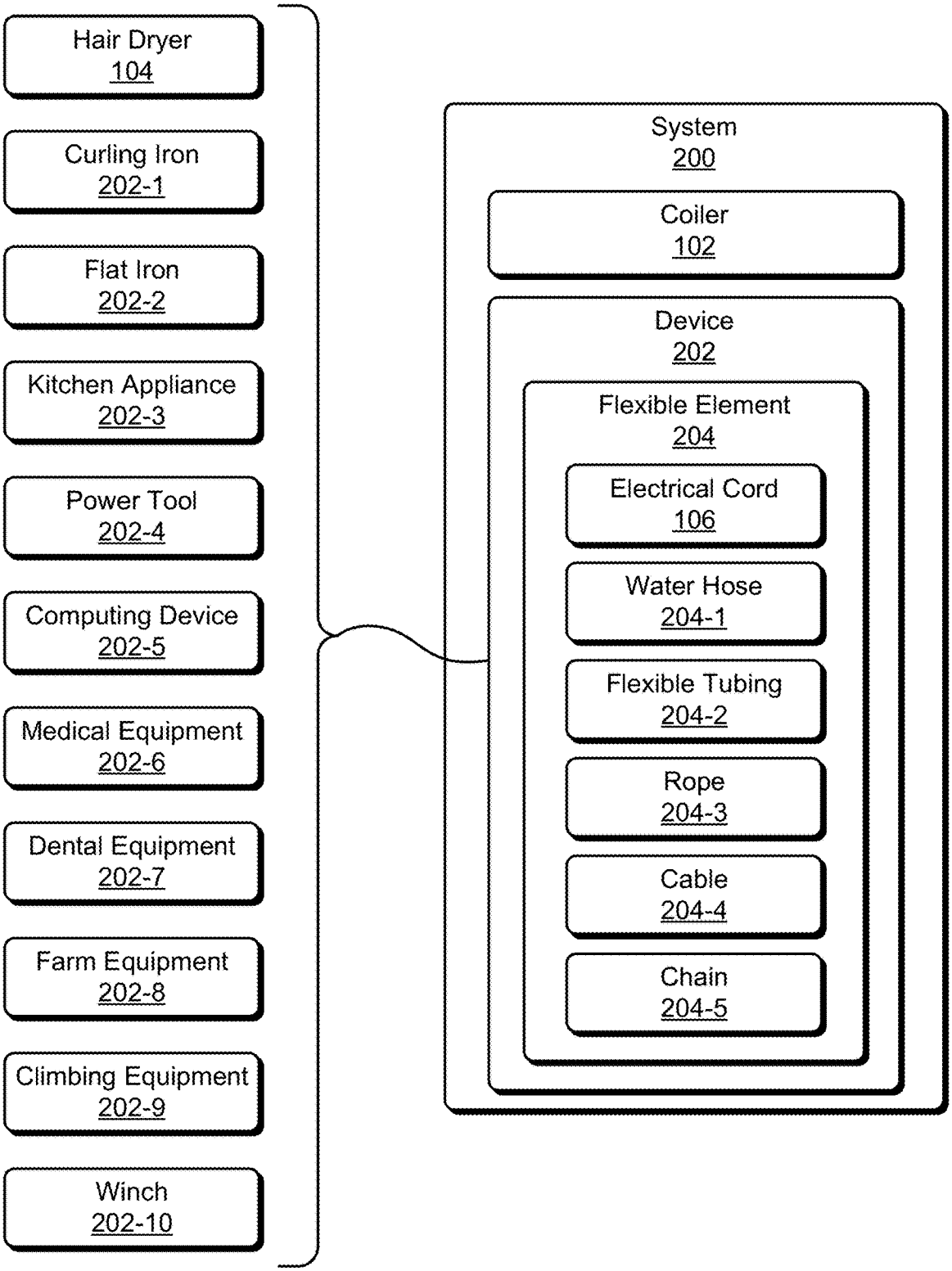
FIG. 2 illustrates an example system with a coiler.

FIG. 2 illustrates an example system 200 that includes the coiler 102. In the depicted configuration, the system 200 also includes at least one device 202 with at least one flexible element 204 (or flexible medium). The flexible element 204 is composed of a type of material that can flex and coil. A shape of a cross section of the flexible element 204 can be round (e.g., circular or oval) or rectangular (e.g., flat). The flexible element 204 can include a single strand of flexible material or multiple strands of flexible material. Example types of flexible elements 204 can include the electrical cord 106, a water hose 204-1, flexible tubing 204-2, rope 204-3, cable 204-4, or chain 204-5.

In general, the flexible element 204 includes two ends. A first end of the flexible element 204 can be connected to a source or a fixed point. Example sources can include a power source (e.g., the electrical outlet 108), a water source (e.g., a water spigot), or a storage tank containing liquid or gas. A second end of the flexible element 204 can be connected to the device 202. In some devices 202, the second end is attached to or integrated within the device 202. In other devices 202, the second end can be optionally removed or disconnected from the device 202. The flexible element 204 can allow particles to flow from the source to the device 202. For example, the flexible element 204 can allow electrical current or fluid (in liquid or gas form) to flow from the source to the device 202. The flow of particles provided by the flexible element 204 can enable the device 202 to operate.

The coiler 102 can coil (e.g., wind or wrap) the flexible element 204 for convenient storage or uncoil (e.g., unwind or unwrap) the flexible element 204 to enable a user to operate the device 202. The coiler 102 enables the device 202 to operate while the flexible element 204 is in a coiled state, an uncoiled state, or a partially-coiled state.

The device 202 can include a variety of different electrical devices. In this case, the flexible element 204 includes the electrical cord 106. Example electrical devices 202 can include hair equipment, such as the hair dryer 104, a curling iron 202-1, or a flat iron 202-2. As another example, the device 202 can include a kitchen appliance 202-3, such as a mixer, a toaster, or a food processor. The device 202 can alternatively be a power tool 202-4, such as a corded drill or an angle grinder. Other types of electrical devices 202 include computing devices 202-5 or medical equipment 202-6. Example computing devices 202-5 include a smartphone or a laptop. Example medical equipment 202-6 can include a sensor, such as a heart-monitoring sensor.

Other types of devices 202 use fluids (e.g. liquids or gas). In this case, the flexible element 204 can include the water hose 204-1 or the flexible tubing 204-2. Example fluid-based devices 202 can include medical equipment 202-6 or dental equipment 202-7. The medical equipment 202-6 can include an oxygen mask or an intravenous (IV) system. The dental equipment 202-7, can include a suction device or an ultrasonic scaler. Other types of fluid-based devices 202 include farm equipment 202-8, such as a tank sprayer.

Still other types of devices 202 rely on the tension of the flexible element 204. In this case, the flexible element 204 can include the rope 204-3, the cable 204-4, or the chain 204-5. Example tension-based devices 202 can include climbing equipment 202-9, such as a lifeline, or a winch 202-10.

In general, the coiler 102 can be used interchangeably with a variety of different devices 202, including those with different power requirements. As such, a user can safely use the coiler 102 with the hair dryer 104 or a power tool 202-4. Other systems 200 can include the coiler 102 and the flexible element 204 without including a device 202. For example, the system 200 can include the coiler 102 and the water hose 204-1. The coiler 102 is further described with respect to FIG. 3.

Figure 3:
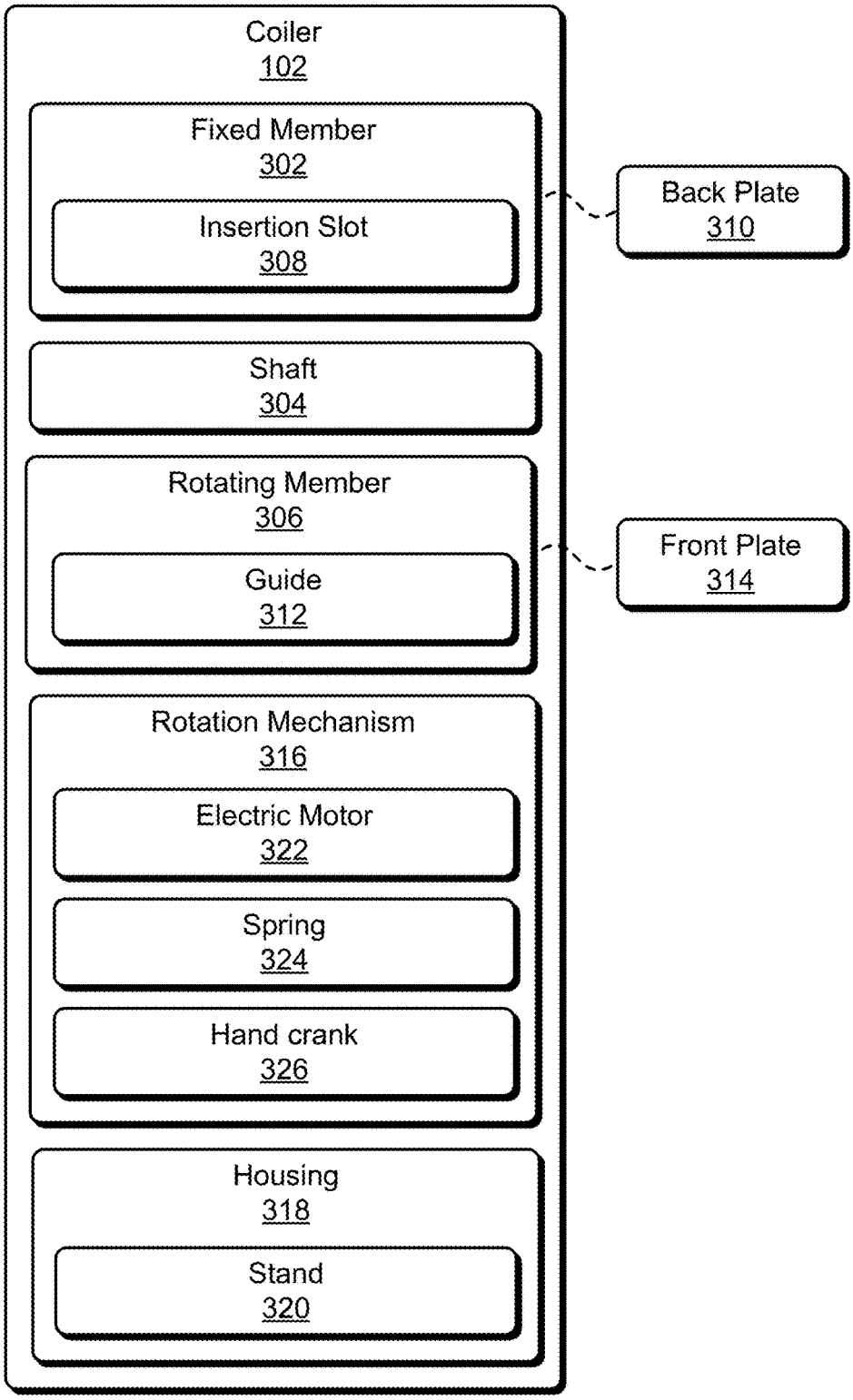
FIG. 3 illustrates example components of a coiler.

FIG. 3 illustrates example components of the coiler 102. In the depicted configuration, the coiler 102 includes at least one fixed member 302, at least one shaft 304, and at least one rotating member 306. The fixed member 302 includes an insertion slot 308. The insertion slot 308 receives (e.g., accepts) a section of the flexible element 204 and secures a first portion of the flexible element 204 (e.g., holds the first portion of the flexible element 204 stationary or prevents the first portion of the flexible element 204 from coiling). In some situations, an end of the flexible element 204 that is associated with the first portion of the flexible element 204 is connected to a stationary source. The fixed member 302 can be implemented as a back plate 310, which is further described with respect to FIGS. 4 and 5.

The shaft 304 provides a support for the flexible element 204 to coil around. In some aspects, the shaft 304 can have a tapered structure to assist the flexible element 204 in coiling around the shaft 304 in an orderly fashion. A length of the shaft 304 can be designed to fit a particular length of the flexible element 204. A diameter of the shaft 304 can be tailored to enable the flexible element 204 to neatly coil around the shaft 304. Such shaft dimensions (e.g., structure, length, diameter) can be adapted to enable the flexible element 204 to be wound around the shaft 304 in substantially concentric rings. An example design of the shaft 304 is further described with respect to FIG. 7.

The rotating member 306 performs the action of coiling and uncoiling the flexible element 204. In some implementations, the rotating member 306 has a circular shape. The rotating member 306 includes a guide 312, which enables the flexible element 204 to pass through the rotating member 306 and presents the flexible element 204 at an approximate 90 degree angle to the direction of rotation. In some cases, the angle is approximately equal to 80, 85, 88, 92, 95, or 100 degrees. In general, the term "approximately" can mean that any of the angles can be within +/−10% of a specified value or less (e.g., within +/−5%, +/−3%, or +/−2% of a specified value). The guide 312 represents an opening, cutout, gap, or hole, which is present within the rotating member 306. In general, a size of the guide 312 is larger than a cross-sectional size (e.g., diameter) of the flexible element 204 to reduce tension or stress on the flexible element 204 as it passes through the rotating member 306. The guide 312 can also include at least one roller, which freely rotates to reduce friction between the guide 312 and the flexible element 204. An example implementation of the roller is further described with respect to FIG. 5. The rotating member 306 can be implemented as a front plate 314, as further described with respect to FIGS. 4 and 5.

The coiler 102 also includes at least one rotation mechanism 316. The rotation mechanism 316 rotates the rotating member 306. The rotation mechanism 316 can be driven manually or mechanically. In example implementations, the rotation mechanism 316 includes an electric motor 322, a spring 324, or a hand crank 326. The rotation mechanism 316 causes the rotating member 306 to selectively rotate counter-clockwise or clockwise. Accordingly, the rotation mechanism 316 can include an interface enabling the user to specify the direction of rotation. If the rotation mechanism 316 includes an electric motor, the interface can include buttons enabling the user to cause the coiler 102 to coil or uncoil the flexible element 204. The rotation mechanism 316 is further described with respect to FIG. 8.

The coiler 102 can optionally include a housing 318. In an example, the housing 318 encloses the fixed member 302, the shaft 304, the rotating member 306, and the rotation mechanism 316. In this way, the housing 318 can protect these components as well as a coiled portion of the flexible element 204 from sun exposure and weather. The housing 318 can optionally include at least one stand 320, which can hold an end of the flexible element 204 or the device 202 that is attached to the flexible element 204. For example, the stand 320 can include an opening for placing the hair dryer 104, the curling iron 202-1, the flat iron 202-2, or the power tool 202-4. In some aspects, the stand 320 can be heat or corrosion resistant.

The fixed member 302, the shaft 304, the rotating member 306, portions of the rotation mechanism 316, and the housing 318 can be built from a variety of different materials, including plastic, metal, wood, or some combination thereof. The coiler 102 is further described with respect to FIG. 4.

Figure 4:
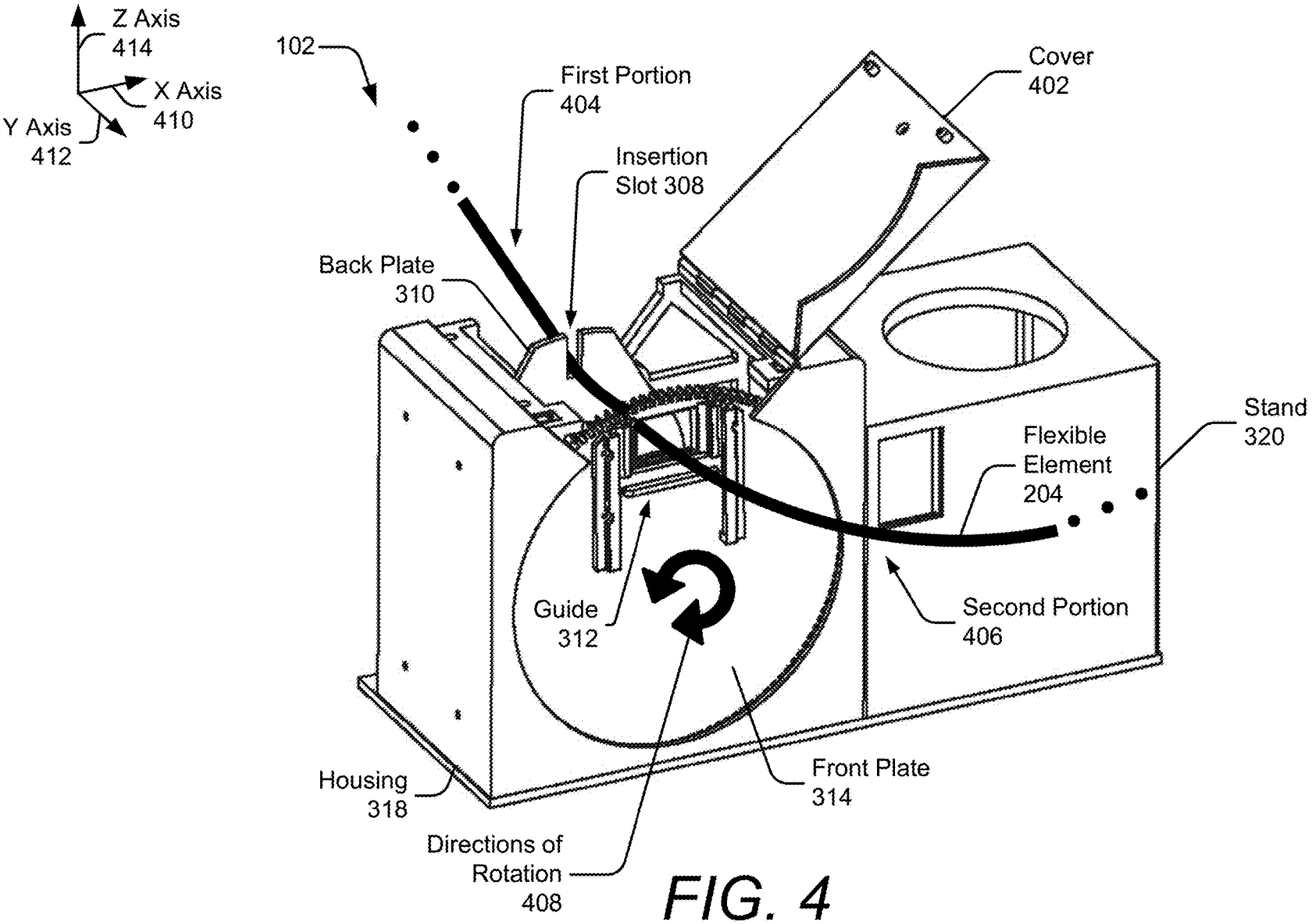
FIG. 4 illustrates an example implementation of a coiler.

FIG. 4 illustrates an example implementation of the coiler 102. In the depicted configuration, the housing 318 includes the stand 320 and a cover 402. The housing 318 encloses at least a portion of the front plate 314, at least a portion of the back plate 310, and the shaft 304. In FIG. 4, the shaft 304 is positioned behind the front plate 314 and is not directly visible in the illustrated orientation of the coiler 102. The cover 402 is attached to the housing 318 via a hinge, which enables the cover 402 to provide a user access to the insertion slot 308 and the guide 312.

Figure 6:
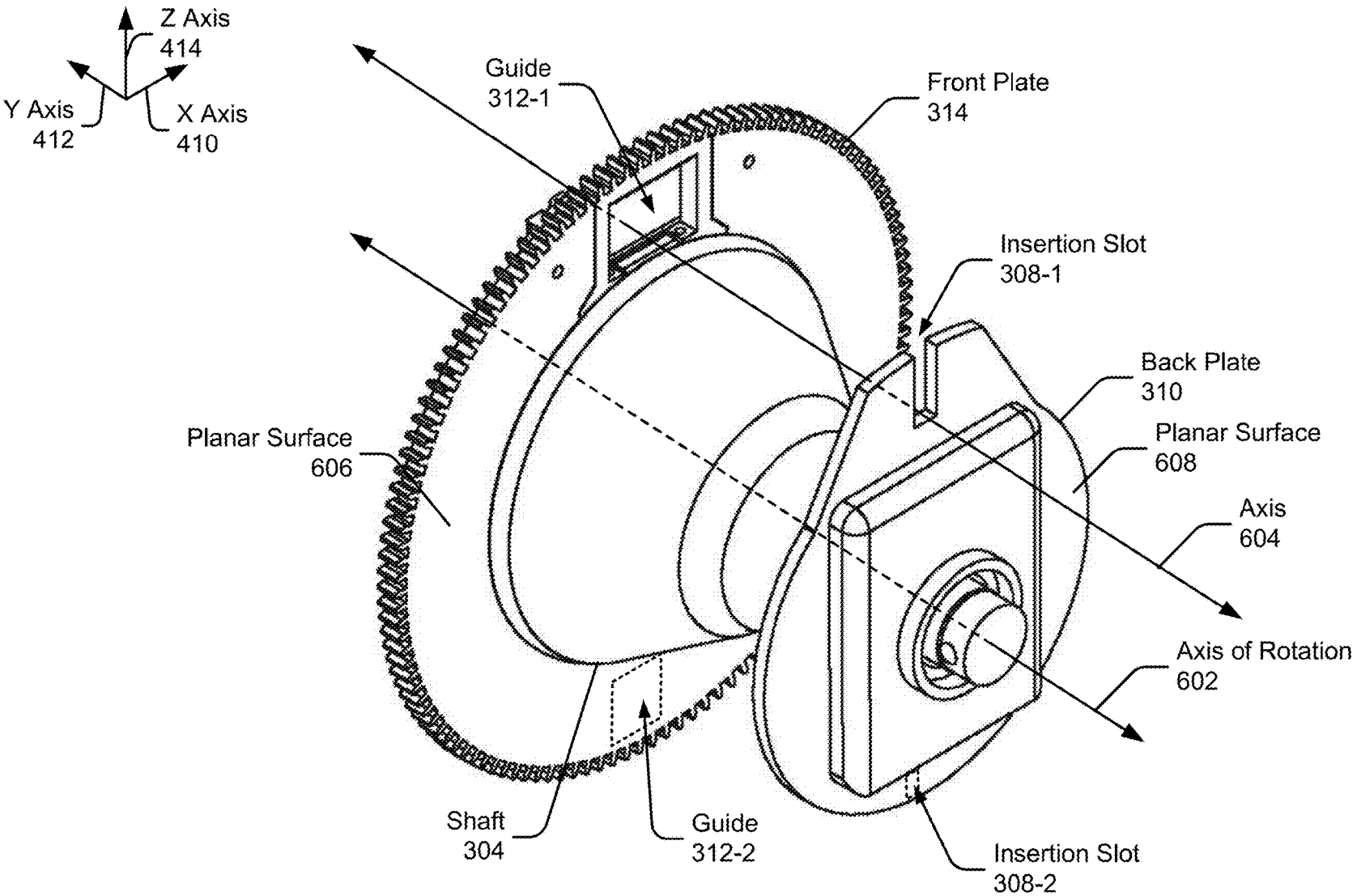
FIG. 6 illustrates examples of a front plate, a shaft, and a back plate of a coiler.

In FIG. 4, a length of the housing 318 is along a first axis 410 (X axis 410), a width of the housing 318 is along a second axis 412 (Y axis 412), and a height of the housing 318 is along a third axis 414 (Z axis 414). The front plate 314 and the back plate 310 have planar surfaces oriented across the first axis 410 and the third axis 414. Accordingly, the front plate 314 and the back plate 310 are arranged substantially parallel to each other. The length of the shaft 304 is oriented along the second axis 412 (as shown in FIG. 6). In this manner, the length of the shaft 304 is substantially perpendicular to the planar surfaces of the front plate 314 and the back plate 310.

To position the flexible element 204 within the coiler 102, the user opens the cover 402 and places a first section of the flexible element 204 in the insertion slot 308. The insertion slot 308 secures a first portion 404 of the flexible element 204, which prevents the first portion 404 of the flexible element 204 from substantially moving as the coiler 102 operates. Because the insertion slot 308 holds the first portion 404 of the flexible element 204 stationary (or at least stationary relative to the shaft 304), the coiler 102 does not coil the first portion 404 of the flexible element 204 around the shaft 304.

The first portion 404 of the flexible element 204 can include an end (e.g., a first end) of the flexible element 204, which the user may connect to a stationary source, such as an electrical outlet 108 or a water spigot. In general, the first portion 404 of the flexible element 204 includes a portion of the flexible element 204 that exists between the insertion slot 308 and the first end of the flexible element 204, which can be connected to the stationary source or the fixed point. As such, a majority of the first portion 404 is positioned outside of the housing 318.

In some situations, the user can pass a second portion 406 of the flexible element 204 through the guide 312. In general, the second portion 406 of the flexible element 204 includes a portion of the flexible element 204 that is between the insertion slot 308 and an end (e.g., a second end) of the flexible element 204 that is connected to the device 202 or is handled by the user. In contrast to the first portion 404 of the flexible element 204, the coiler 102 can coil the second portion 406 of the flexible element 204 around the shaft 304.

Figure 5:
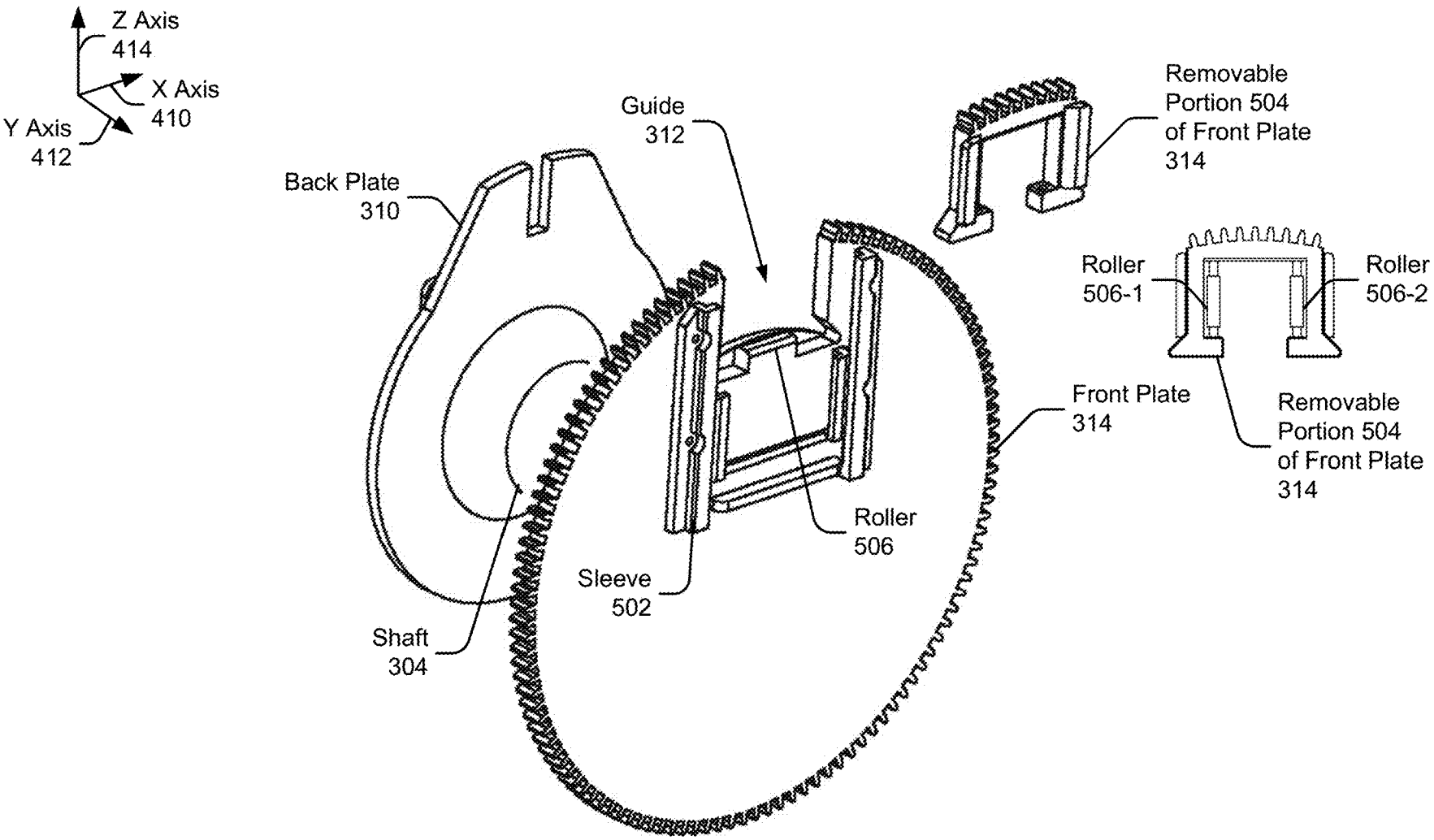
FIG. 5 illustrates an example front plate and an example guide of a coiler.

To assist the user in placing the second portion 406 of the flexible element 204 through the guide 312, the front plate 314 can optionally include a removable portion, as further described with respect to FIG. 5. This can make it easier for the user to place the second portion 406 of the flexible element 204 through the guide 312, especially in situations in which the flexible element 204 is significantly long or the flexible element 204 is connected to a device 202 that cannot fit through the guide 312.

To use the coiler 102, a user activates the rotation mechanism 316, which causes the front plate 314 to rotate in a first direction to coil the flexible element 204. As the front plate 314 rotates, the second portion 406 of the flexible element 204 moves through the guide 312 and coils around the shaft 304. To uncoil the flexible element 204, the user can activate the rotation mechanism 316 to cause the front plate 314 to rotate in a second direction, which is opposite the first direction. As an example, the first direction can be a clockwise direction and the second direction can be a counter-clockwise direction, or vise-versa. In FIG. 4, these two directions are represented by directions of rotation 408.

While the front plate 314 rotates, the back plate 310 and the shaft 304 remain relatively stationary. Consequently, the tension on the flexible element 204 and the rotation of the front plate 314 relative to the stationary back plate 310 causes the flexible element 204 to coil or uncoil. Because the back plate 310 enables the first portion 404 of the flexible element 204 to remain relatively stationary, the flexible element 204 can be directly connected to a stationary source (e.g., the electrical outlet 108 or a water spigot) or a fixed position.

Although not shown in FIG. 4, other implementations of the coiler 102 can include multiple guides 312 and multiple insertion slots 308 to enable simultaneous coiling and uncoiling of multiple flexible elements 204. For example, the front plate 314 in FIG. 4 can include a second guide positioned opposite the guide 312, and the back plate 310 can include a second insertion slot positioned opposite the insertion slot 308, as further described with respect to FIG. 6. As such, the second insertion slot 308 can secure a first portion of a second flexible element while the second guide enables a second flexible element to pass through the front plate 314 as the front plate 314 rotates. An illustration of the flexible element 204 being partially-coiled is further described with respect to FIG. 9. Example implementations of the guide 312 and the front plate 314 are further described with respect to FIG. 5.

FIG. 5 illustrates an example front plate 314 and an example guide 312 of the coiler 102. In the depicted configuration, the front plate 314 includes a sleeve 502 and a removable portion 504. The sleeve 502 secures the removable portion 504 in place during operation (e.g., as the front plate 314 rotates). However, the user can optionally slide the removable portion 504 out of the sleeve 502 to access the guide 312. By removing the removable portion 504, the user can directly access the guide 312 and lay a section of the flexible element 204 across the guide 312. After this section of the flexible element 204 is placed across the guide 312, the user can slide the removable portion 504 back into the sleeve 502.

In an alternative implementation (not shown), the front plate 314 can include a snap closure instead of the removable portion 504. The snap closure can snap in place across the guide 312 or rotatably move (e.g., swing) away via a hinge to allow a user access to the guide 312.

In FIG. 5, the guide 312 is shown to include at least one roller 506, which can freely rotate about a central axis (not illustrated). The roller 506 is positioned on one side of the guide 312 and is designed to come in contact with (e.g., abut) the flexible element 204. As the flexible element 204 moves through the guide 312, the roller 506 rolls. This rolling action can reduce the friction between the guide 312 and the flexible element 204 in comparison to implementations in which the flexible element 204 slides across a side of the guide 312.

In other implementations, the guide 312 can include multiple rollers 506. For example, the guide 312 can include two rollers 506 on opposite sides or four rollers 506 on individual sides. The rollers 506 can be installed within the front plate 314 or as part of the removable portion 504 of the front plate 314. As an example, the removable portion 504 can have two rollers 506 on opposite sides (e.g., one roller 506-1 on the left side and another roller 506-2 on the right side). Additional features of the coiler 102 are further described with respect to FIG. 6.

FIG. 6 illustrates examples of the front plate 314, the shaft 304, and the back plate 310 of the coiler 102. In the depicted configuration, the shaft 304 is positioned between the front plate 314 and the back plate 310 such that a length of the shaft 304 is oriented along the second axis 412. In some aspects, the shaft 304 has a first end that is positioned proximate to the back plate 310 and a second end that is positioned proximate to the front plate 314. For a compact design, the first end of the shaft 304 can abut the back plate 310 and/or the second end can abut the front plate 314. In an example implementation, the front plate 314 is connected to a rod, which passes through a center of the shaft 304 and can spin freely. In some implementations, the rod also passes through the back plate 310.

An axis of rotation 602 passes through a center of the front plate 314 and is parallel to the second axis 412. A center of the shaft 304 is positioned on the axis of rotation 602. A planar surface 606 of the front plate 314 and a planar surface 608 of the back plate 310 can be approximately perpendicular to the axis of rotation 602.

As shown in FIG. 6, the front plate 314 includes at least a first insertion slot 308-1, and the back plate 310 includes at least a first guide 312-1. In some implementations, the front plate 314 also includes a second insertion slot 308-2, and the back plate 310 also includes a second guide 312-2. The first guide 312-1 is offset from the axis of rotation 602. Also, the first insertion slot 308-1 can be offset from the axis of rotation 602 by a similar or different amount as the first guide 312-1. In general, a portion of the flexible element 204 that is placed within the first insertion slot 308-1 (e.g., a small section of the first portion 404 of the flexible element 204) is aligned with an axis 604, which is approximately parallel to the axis of rotation 602. For example, the portion of the flexible element 204 that is positioned within the first insertion slot 308-1 is positioned to longitudinally extend in a direction that is substantially aligned with the axis 604. Also, another portion of the flexible element 204 that passes through the first guide 312-1 (e.g., a small section of the second portion 406 of the flexible element 204) is aligned with the axis 604 (or another axis that is approximately parallel to the axis of rotation 602). For example, the portion of the flexible element 204 that is positioned within the first guide 312-1 is positioned to longitudinally extend in a direction that is substantially aligned with the axis 604. In this manner, the first guide 312-1 presents the flexible element 204 in a manner that is perpendicular to the direction of rotation, as further described with respect to FIGS. 9 and 10. A design of the shaft 304 enables the flexible element 204 to be coiled, as further described with respect to FIG. 7.

Figure 7:
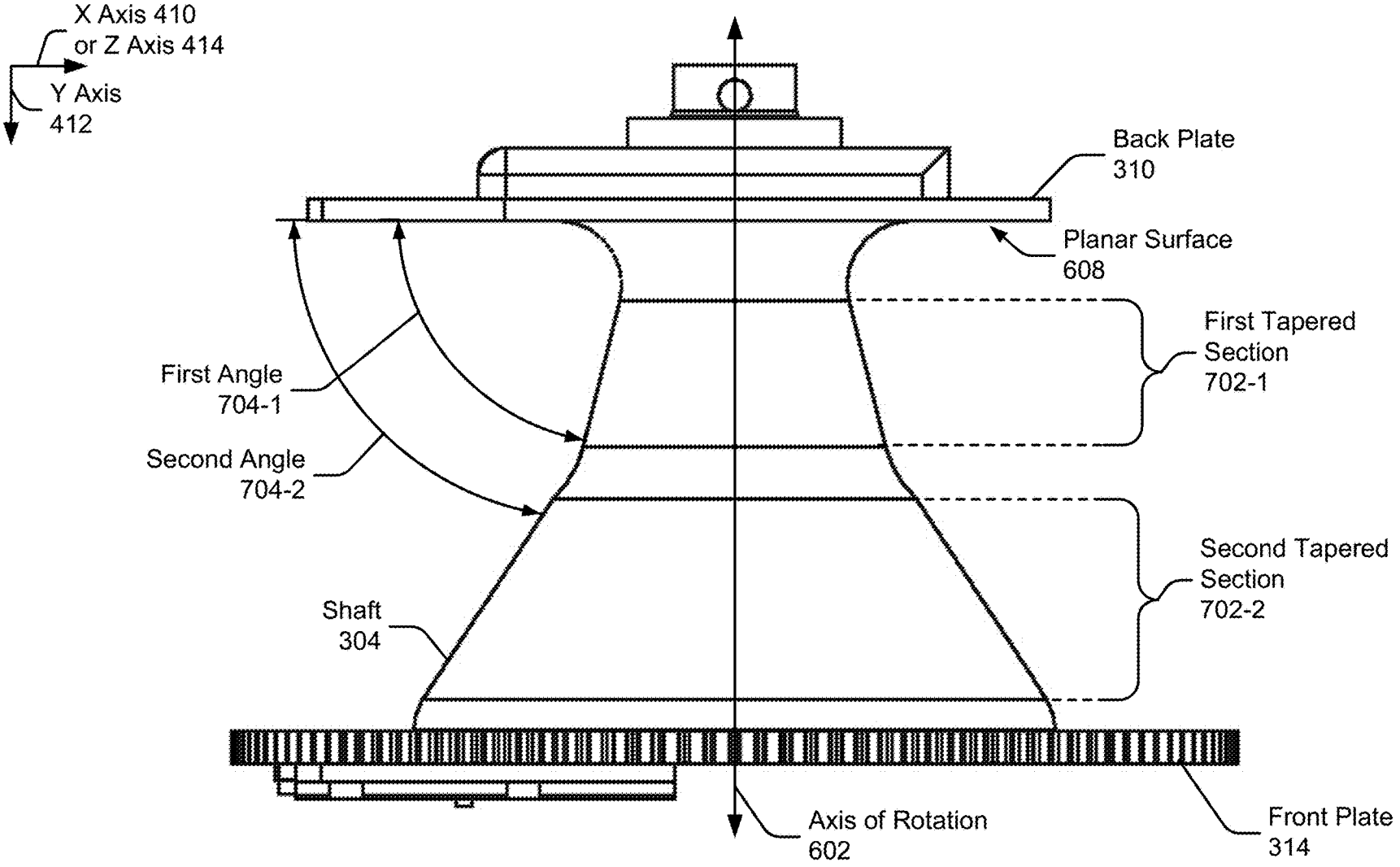
FIG. 7 illustrates an example implementation of a shaft of a coiler.
Figure 9:
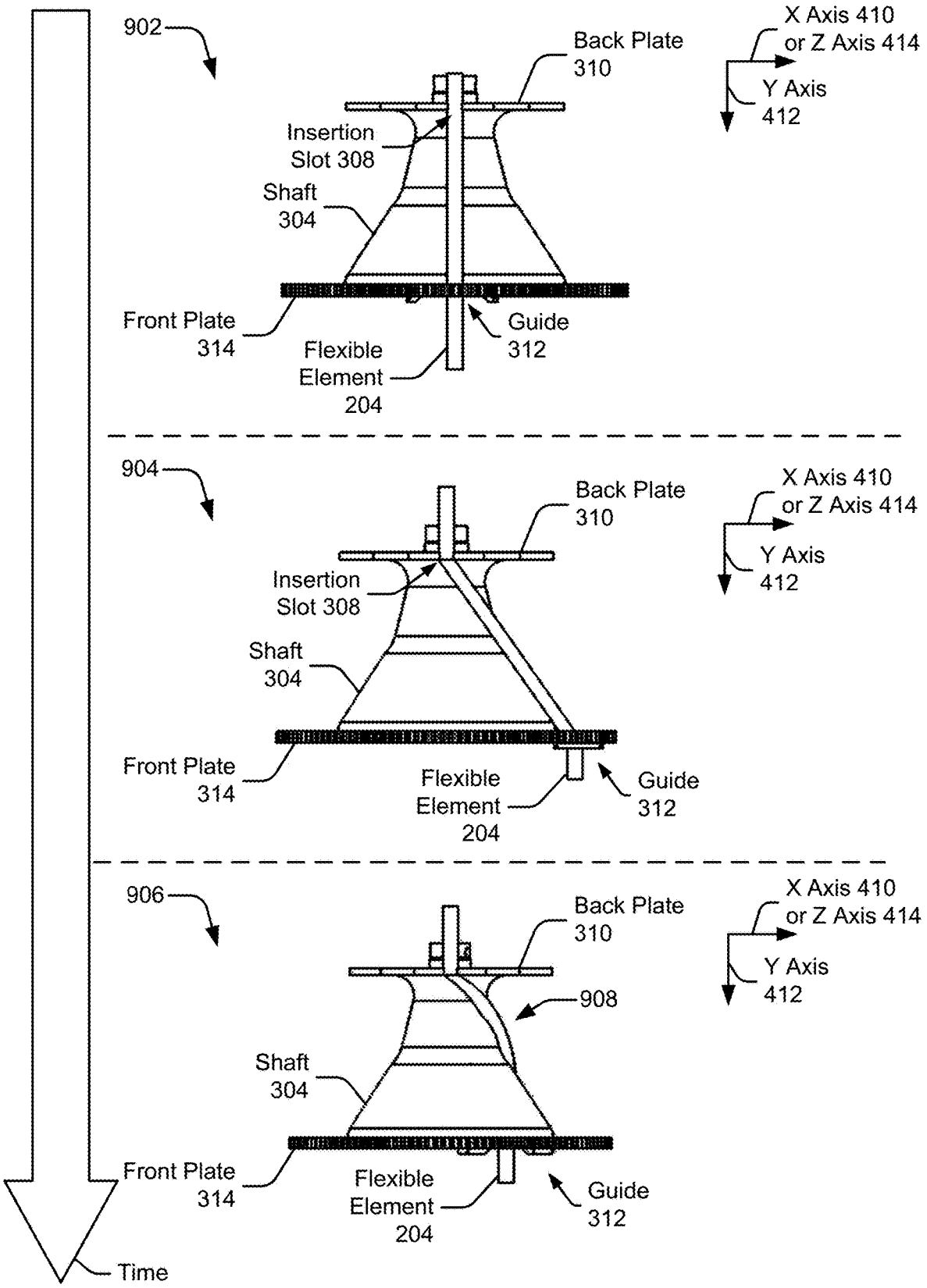
FIG. 9 illustrates an example sequence for coiling a flexible element using a coiler.
Figure 10:
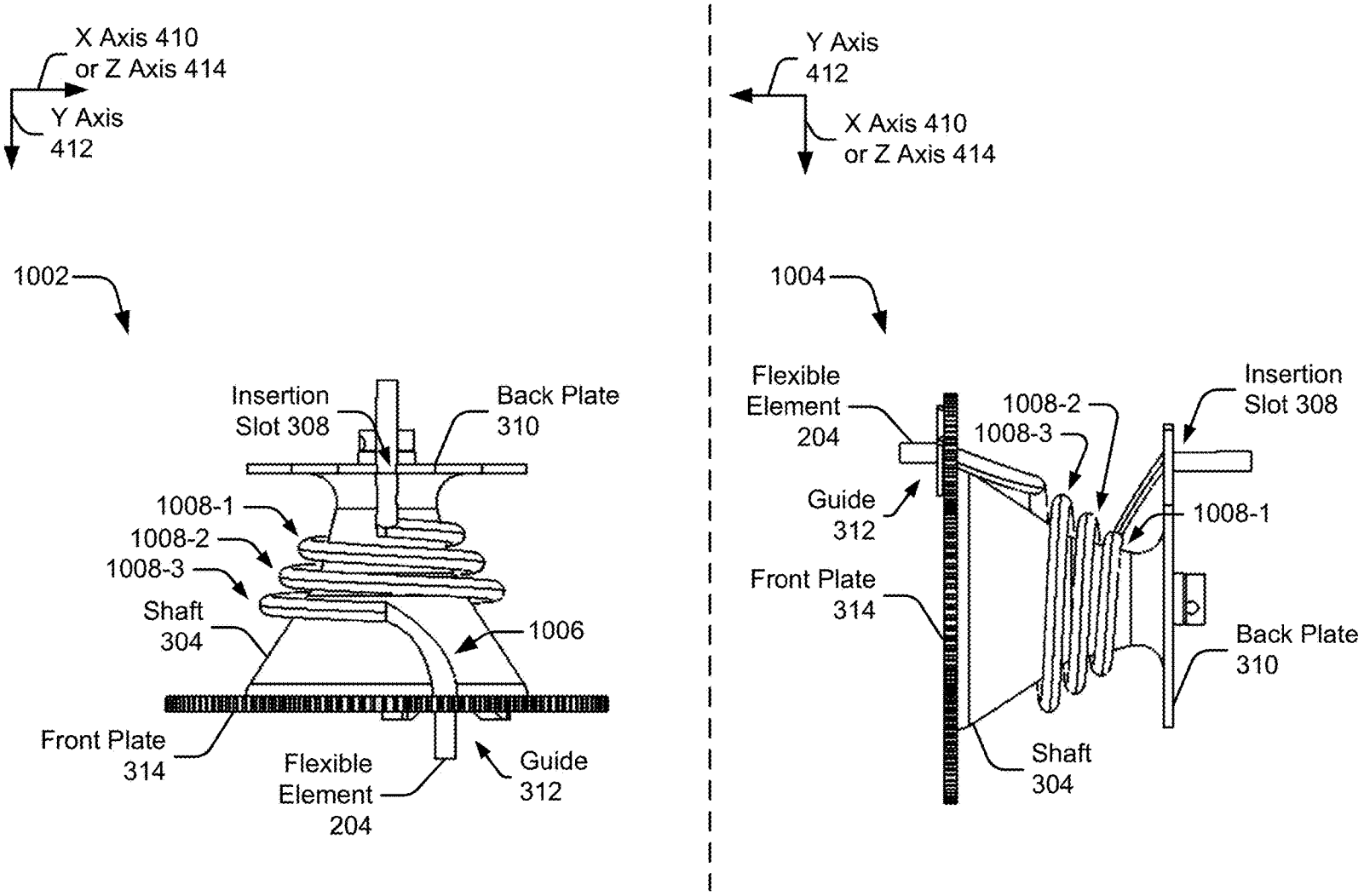
FIG. 10 illustrates example coils of a flexible element formed by a coiler.

FIG. 7 illustrates an example implementation of the shaft 304 of the coiler 102. The shaft 304 includes at least one tapered section 702. In general, the tapered section 702 enables the flexible element 204 to slide towards the back plate 310 and neatly coil around the shaft 304, as shown in FIGS. 9 and 10. In an example implementation, the tapered section 702 has a slope that forms an angle relative to a planar surface 608 of the back plate 310 (e.g., an angle between the second axis 412 and the first axis 410 or the third axis 414). The angle can be between approximately 60 and 80 degrees, between approximately 62 and 78 degrees, or between approximately 65 and 75 degrees. In some cases, the angle is approximately equal to 60, 65, 70, 75, or 80 degrees. In general, the term "approximately" can mean that any of the angles can be within +/−5% of a specified value or less (e.g., within +/−5%, +/−3%, or +/−2% of a specified value).

In the depicted configuration, the shaft 304 includes a first tapered section 702-1 and a second tapered section 702-2. The first tapered section 702-1 is positioned proximate to the back plate 310, and the second tapered section 702-2 is positioned proximate to the front plate 314. The first tapered section 702-1 has a slope with a first angle 704-1 relative to the planar surface 608 of the back plate 310. The second tapered section 702-2 has a slope with a second angle 704-2 relative to the planar surface 608 of the back plate 310. The first angle 704-1 is greater than the second angle 704-2 (e.g., by at least 1, 5, 10, or 15 degrees). As an example, the first angle 704-1 can be approximately 78 degrees, and the second angle 704-2 can be approximately 62 degrees.

If the shaft 304 includes multiple tapered sections 702, the angles of the slopes of the tapered sections 702 can decrease as the tapered sections 702 are positioned closer to the front plate 314. In this way, the shaft 304 has a larger diameter closer to the front plate 314 and a smaller diameter closer to the back plate 310. Components of the rotation mechanism 316 are further described with respect to FIG. 8.

Figure 8:
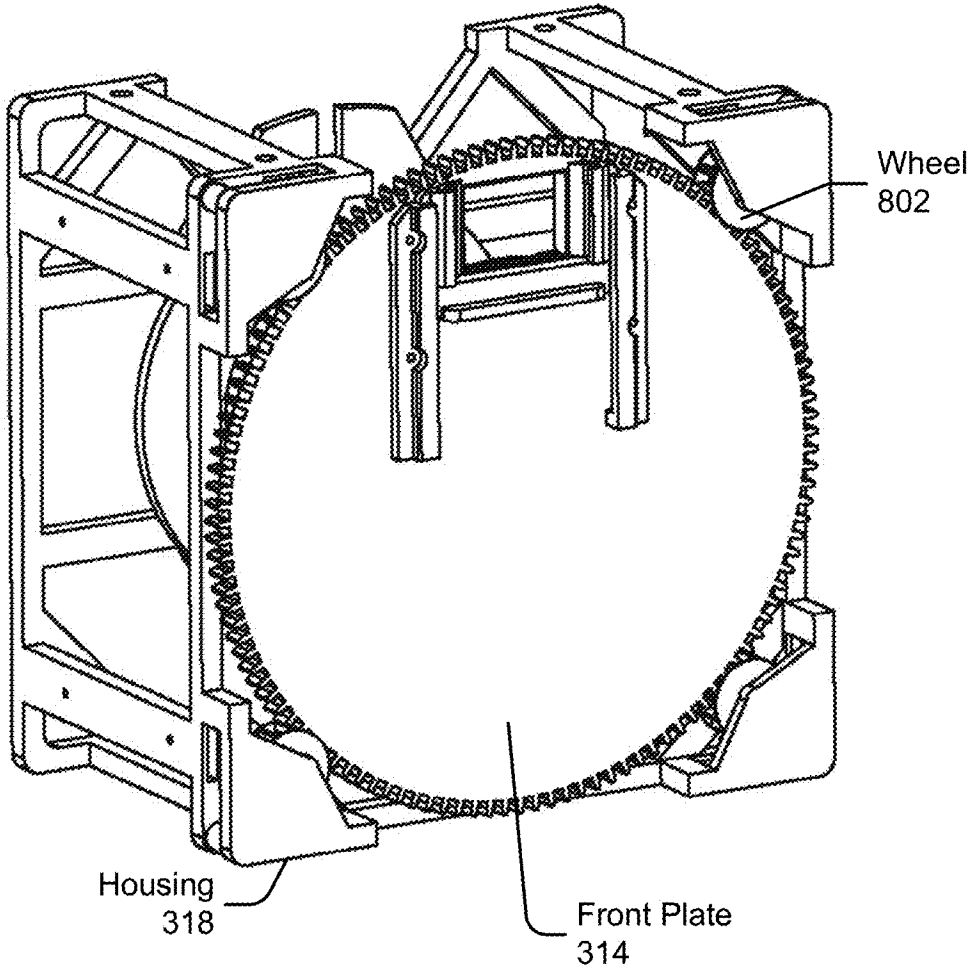
FIG. 8 illustrates an example implementation of a rotation mechanism of a coiler.

FIG. 8 illustrates an example implementation of the rotation mechanism 316 of the coiler 102. In the depicted configuration, the rotation mechanism 316 includes at least one wheel 802 (e.g., one wheel, two wheels, or four wheels) and an electrical motor (not shown). The electrical motor causes the wheel 802 to rotate in a specified direction.

The wheel 802 is in contact with an edge of the front plate 314. As the wheel 802 rotates, the wheel 802 causes the front plate 314 to rotate. In some implementations, the front plate 314 and the wheel 802 are implemented as intermeshing gears. Aspects of the rotation of the front plate 314 are further described with respect to FIGS. 9 and 10.

FIG. 9 illustrates an example sequence for coiling the flexible element 204. At 902, the flexible element 204 is positioned across the insertion slot 308 of the back plate 310 and through the guide 312 of the front plate 314. If the guide 312 is approximately aligned with the insertion slot 308 along the axis 604, a length of the flexible element 204 between the guide 312 and the insertion slot 308 can be approximately parallel to the second axis 412.

At 904, the front plate 314 rotates clockwise such that the guide 312 moves or revolves towards the right of FIG. 9. Due to the tension applied from the insertion slot 308 securing the first portion 404 of the flexible element 204, the flexible element 204 begins to coil around the shaft 304.

At 906, the front plate 314 continues to rotate clockwise such that the guide 312 moves or revolves towards the left of FIG. 9. This causes the flexible element 204 to begin to coil around the shaft 304, as shown at 908. Also at 908, the flexible element 204 begins to bend and form an approximate 90 degree angle between the insertion slot 308 and the guide 312. In general, this angle forms along the second axis 412 and a plane defined by the first axis 410 and the third axis 414.

The tension applied from the insertion slot 308 securing the first portion 404 of the flexible element 204 and the tapered sections 702-1 and 702-2 of the shaft 304 cause the flexible element 204 to form a first coil closer to the back plate 310 compared to the front plate 314. As the front plate 314 rotates, additional coils are formed, as further described with respect to FIG. 10.

FIG. 10 illustrates example coils of the flexible element 204, which form around the shaft 304. At 1002, a top-down view of the front plate 314, the back plate 310, and the flexible element 204 is shown. At 1004, a side view of the front plate, 314, the back plate 310, and the flexible element 204 is shown. As the front plate 314 rotates, the guide 312 presents the flexible element 204 in a manner that is parallel to the axis of rotation 602 and perpendicular to the direction of rotation. As a result, the flexible element 204 forms an approximate 90 degree angle shown at 1006. In particular, the flexible element 204 bends approximately 90 degrees between a coiled portion of the flexible element 204 and a portion of the flexible element that is positioned through the guide 312.

In this example, the flexible element 204 is coiled three times around the shaft 304 to form coils 1008-1, 1008-2, and 1008-3. Due to the tapered sections 702-1 and 702-2 of the shaft 304, the coils 1008-1 to 1008-3 are arranged in an orderly fashion. In particular, a first coil 1008-1 forms proximate to the back plate 310, a second coil 1008-2 forms between the first coil 1008-1 and the front plate 314, and a third coil 1008-3 forms between the second coil 1008-2 and the front plate 314. Sometimes, the coils 1008-1 to 1008-3 can abut adjacent coils 1008. For example, the coil 1008-2 can abut the coils 1008-1 and 1008-3. Although not explicitly shown, multiple layers of coils 1008 can form as additional portions of the flexible element 204 coil around the shaft 304.

Example Method

Figure 11:
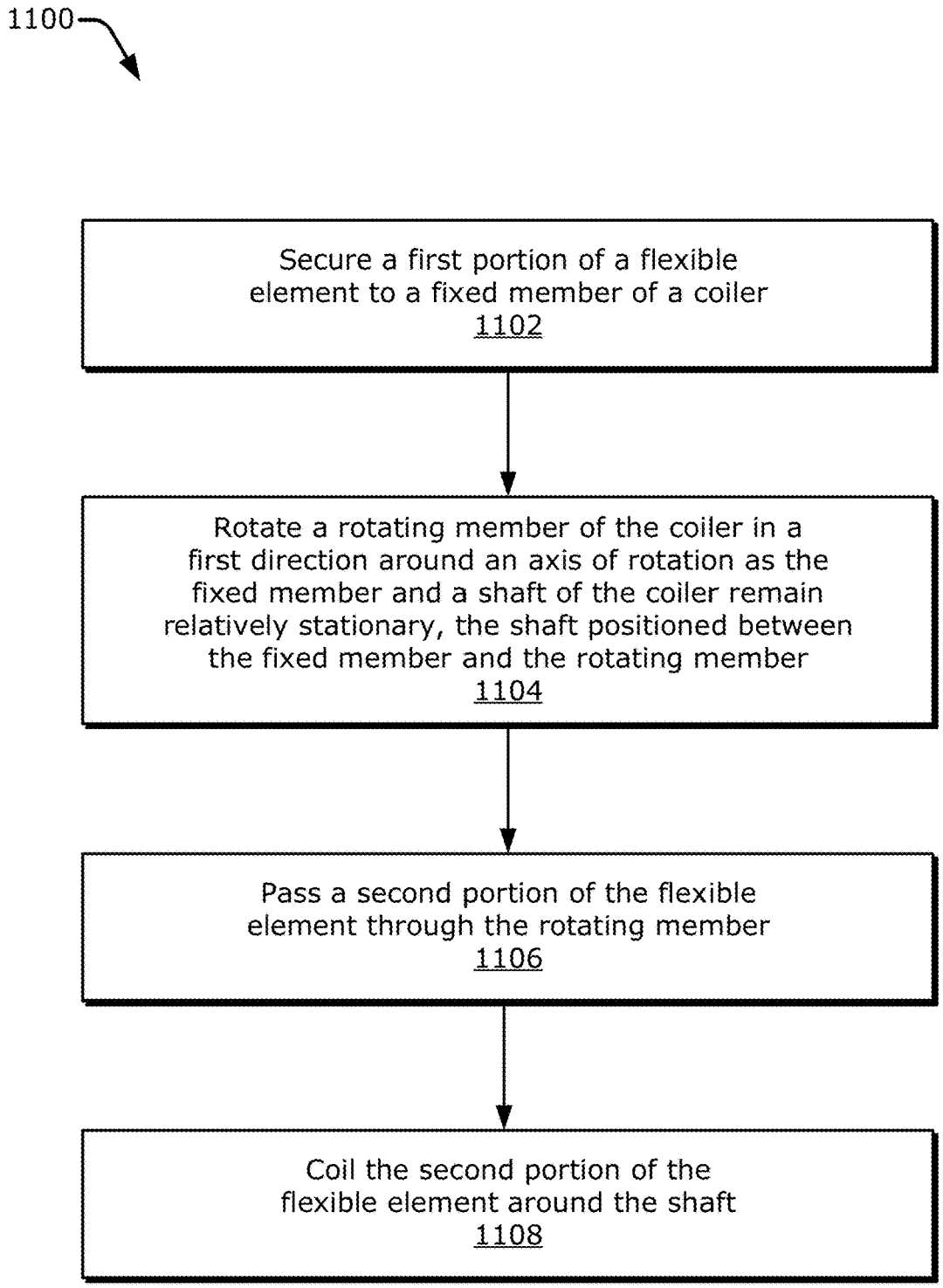
FIG. 11 illustrates an example method performed by a coiler.

FIG. 11 depicts an example method 1100 for performing operations of coiling a flexible element using a coiler. Method 1100 is shown as sets of operations (or acts) performed but not necessarily limited to the order or combinations in which the operations are shown herein. Further, any of one or more of the operations may be repeated, combined, reorganized, or linked to provide a wide array of additional and/or alternate methods. In portions of the following discussion, reference may be made to the environment 100 of FIG. 1, and entities detailed in FIG. 2 or 3, reference to which is made for example only. The techniques are not limited to performance by one entity or multiple entities operating on one device.

At 1102, a first portion of a flexible element is secured to a fixed member of a coiler. For example, the insertion slot 308 of the fixed member 302 (e.g., the back plate 310) secures the first portion 404 of the flexible element 204 to the fixed member 302, as shown in FIG. 4. In this way, the coiler 102 does not coil the first portion 404 of the flexible element 204 around the shaft 304. Due the insertion slot 308 securing the first portion of the flexible element, the first portion 404 of the flexible element 204 can be substantially stationary as the coiler 102 coils or uncoils the second portion 406 of the flexible element 204.

At 1104, a rotating member of a coiler is rotated in a first direction around an axis of rotation as the fixed element and a shaft of the coiler remain relatively stationary. The shaft is positioned between the fixed member and the rotating member. For example, the rotation mechanism 316 rotates the rotating member 306 (e.g., the front plate 314) in a first direction around the axis of rotation 602 as the fixed member 302 and the shaft 304 remain relatively stationary compared to the rotating member 306, as shown in FIG. 4. In other words, the fixed member 302 and the shaft 304 do not rotate as the rotating member 306 rotates. In general, the rotation of the rotating member 306 causes the second portion 406 of the flexible element 204 to revolve with the guide 312 and the ben coiled around the shaft 304. The shaft 304 is positioned between the fixed member 302 and the rotating member 306. The first direction can be a clockwise direction or a counter-clockwise direction.

At 1106, a second portion of the flexible element is passed through the rotating member. For example, the guide 312 passes the second portion 406 of the flexible element 204 to through the rotating member 306. In some implementations, the guide 312 can include at least one roller 506 to enable the flexible element 204 to pass through the rotating member 306 with less friction and tension in comparison to a fixed side that the flexible element 204 slidably moves across.

At 1108, the second portion of the flexible element is coiled around the shaft. For example, the coiler 102 coils the second portion 406 of the flexible element 204 around the shaft 304. In some implementations, the shaft 304 can include one or more tapered sections 702 to enable the flexible element 204 to start coiling closer to the back plate 310 than the front plate 314, as shown in FIGS. 7, 9, and 10.

Conclusion

Although techniques using, and apparatuses including, a coiler have been described in language specific to features and/or methods, it is to be understood that the subject of the appended claims is not necessarily limited to the specific features or methods described. Rather, the specific features and methods are disclosed as example implementations of a coiler.

Some examples are provided below.

Example 1: A coiler comprising:

a fixed member comprising an insertion slot, the insertion slot configured to secure a first portion of a flexible element;

a shaft having first and second ends, the first end positioned proximate to the fixed member;

a rotating member positioned proximate to the second end of the shaft and configured to rotatably move about an axis of rotation, the rotating member comprising a guide offset from the axis of rotation, the guide configured to enable a second portion of the flexible element to pass through the rotating member; and a rotation mechanism configured to rotate the rotating member in a first direction around the axis of rotation to coil the second portion of the flexible element around the shaft.

Example 2: The coiler of example 1, wherein the fixed member and the shaft are configured to be substantially stationary while the rotating member rotates in the first direction.

Example 3: The coiler of example 1 or 2, wherein the insertion slot of the fixed member is configured to hold the first portion of the flexible element at a fixed position while the second portion of the flexible element coils around the shaft.

Example 4: The coiler of any preceding example, wherein the guide of the rotating member is configured to position the second portion of the flexible element along another axis that is approximately parallel to the axis of rotation and perpendicular to a direction of rotation.

Example 5: The coiler of any preceding example, wherein:

a length of the shaft is positioned along the axis of rotation;

a planar surface of the rotating member is approximately perpendicular to the axis of rotation; and a planar surface of the fixed member is approximately perpendicular to the axis of rotation.

Example 6: The coiler of any preceding example, wherein the guide of the rotating member comprises at least one roller configured to freely rotate to enable the flexible element to pass through the rotating member.

Example 7: The coiler of any preceding claim, wherein the rotation mechanism is configured to rotate the rotating member in a second direction around the axis of rotation to uncoil the second portion of the flexible element, the second direction being opposite the first direction.

Example 8: The coiler of any preceding example, wherein the shaft is configured to have at least one tapered section.

Example 9: The coiler of any preceding example, wherein the at least one tapered section of the shaft is configured to cause the second portion of the flexible element to form a first coil proximate to the fixed member.

Example 10: The coiler of example 8, wherein the at least one tapered section has a slope that forms an angle between approximately 60 and 80 degrees relative to a planar surface of the fixed member.

Example 11: The coiler of any preceding example, wherein:

the fixed member comprises a second insertion slot, the second insertion slot configured to receive a first portion of a second flexible element;

the rotating member comprises a second guide that is offset from the axis of rotation, the second guide configured to enable a second portion of the second flexible element to pass through the rotating member; and the rotation mechanism is configured to rotate the rotating member in the first direction around the axis of rotation to coil both the second portion of the first flexible element and the second portion of the second flexible element around the shaft.

Example 12: The coiler of any preceding example, wherein the rotation mechanism comprises at least one of:

an electric motor;

a spring; or a hand crank.

Example 13: The coiler of example 12, wherein:

the rotating member has a circular shape and an edge; and the rotation mechanism comprises:

at least one wheel configured to be contact with the edge of the rotating member; and the electric motor configured to rotate the at least one wheel to cause the rotating member to rotate.

Example 14: The coiler of example 13, wherein the rotating member and the at least one wheel comprise intermeshing gears.

Example 15: An apparatus comprising:

a shaft;

fixed means for securing a first portion of a flexible element; and rotating means for coiling a second portion of the flexible element around the shaft as the shaft and the fixed means remains stationary compared to the rotating means.

Example 16: The apparatus of example 15: further comprising: means for storing a device attached to the second portion of the flexible element.

Example 17: A system comprising:

at least one flexible element; and a coiler of examples 1 to 14.

Example 18: The system of example 17, wherein the at least one flexible element comprises at least one the following:

an electrical cord;

a water hose;

flexible tubing;

rope;

cable; or chain.

Example 19: The system of example 17, wherein the at least one flexible element has a round shape or a rectangular shape.

Example 20: A method performed by a coiler, the method comprising:

securing a first portion of a flexible element stationary to a fixed member of the coiler;

rotating a rotating member of the coiler in a first direction around an axis of rotation as the fixed member and a shaft of the coiler remain relatively stationary, the shaft positioned between the fixed member and the rotating member;

passing a second portion of the flexible element through a guide of the rotating member; and coiling the second portion of the flexible element around the shaft.

The invention claimed is:

1. An apparatus comprising:

a fixed member comprising an insertion slot, the insertion slot configured to secure a first portion of a flexible element;

a shaft having first and second ends, the first end positioned proximate to the fixed member;

a rotating member positioned proximate to the second end of the shaft and configured to rotatably move about an axis of rotation, the rotating member comprising a guide offset from the axis of rotation, the guide configured to enable a second portion of the flexible element to pass through the rotating member; and a rotation mechanism configured to rotate the rotating member in a first direction around the axis of rotation to coil the second portion of the flexible element around the shaft, wherein:

the shaft is configured to be relatively stationary compared to the rotating member; and the shaft comprises at least one tapered section such that the shaft has a first cross-sectional area proximate to the rotating member and a second cross-sectional area proximate to the fixed member, the first cross-sectional area being larger than the second cross-sectional area.

2. The apparatus of claim 1, wherein the fixed member and the shaft are configured to be substantially stationary while the rotating member rotates in the first direction.

3. The apparatus of claim 2, wherein the insertion slot of the fixed member is configured to hold the first portion of the flexible element at a fixed position while the second portion of the flexible element coils around the shaft.

4. The apparatus of claim 1, wherein the guide of the rotating member is configured to position the second portion of the flexible element along another axis that is approximately parallel to the axis of rotation and perpendicular to a direction of rotation.

5. The apparatus of claim 1, wherein:

a length of the shaft is positioned along the axis of rotation;

a planar surface of the rotating member is approximately perpendicular to the axis of rotation; and a planar surface of the fixed member is approximately perpendicular to the axis of rotation.

6. The apparatus of claim 1, wherein the guide of the rotating member comprises at least one roller configured to freely rotate to enable the flexible element to pass through the rotating member.

7. The apparatus of claim 1, wherein the rotation mechanism is configured to rotate the rotating member in a second direction around the axis of rotation to uncoil the second portion of the flexible element, the second direction being opposite the first direction.

8. The apparatus of claim 1, wherein:

the at least one tapered section comprises multiple tapered sections; and slopes of the multiple tapered sections form angles relative to a planar surface of the fixed member that decrease as the tapered sections are positioned closer to the rotating member.

9. The apparatus of claim 1, wherein the at least one tapered section of the shaft is configured to cause the second portion of the flexible element to form a first coil proximate to the fixed member.

10. The apparatus of claim 1, wherein the at least one tapered section has a slope that forms an angle between approximately 60 and 80 degrees relative to a planar surface of the fixed member.

11. The apparatus of claim 1, wherein:

the fixed member comprises a second insertion slot, the second insertion slot configured to receive a first portion of a second flexible element;

the rotating member comprises a second guide that is offset from the axis of rotation, the second guide configured to enable a second portion of the second flexible element to pass through the rotating member; and the rotation mechanism is configured to rotate the rotating member in the first direction around the axis of rotation to coil both the second portion of the first flexible element and the second portion of the second flexible element around the shaft.

12. The apparatus of claim 11, wherein the rotation mechanism comprises at least one of:

an electric motor;

a spring; or a hand crank.

13. The apparatus of claim 12, wherein:

the rotating member has a circular shape and an edge; and the rotation mechanism comprises:

at least one wheel configured to be in contact with the edge of the rotating member; and the electric motor configured to rotate the at least one wheel to cause the rotating member to rotate.

14. The apparatus of claim 13, wherein the rotating member and the at least one wheel comprise intermeshing gears.

15. The apparatus of claim 1, further comprising:

at least one flexible element; and a coiler comprising the fixed member, the shaft, the rotating member, and the rotation mechanism.

16. The apparatus of claim 15, wherein the at least one flexible element comprises at least one of the following:

an electrical cord;

a water hose;
flexible tubing;
rope;
cable; or
chain.

17. The apparatus of claim 15, wherein a cross section of the at least one flexible element has a round shape or a rectangular shape.

18. An apparatus comprising:
a shaft;
fixed means for securing a first portion of a flexible element; and
rotating means for coiling a second portion of the flexible element around the shaft as the shaft and the fixed means remain relatively stationary compared to the rotating means,
wherein the shaft comprises at least one tapered section such that the shaft has a first cross-sectional area that is proximate to the rotating means and a second cross-sectional area that is proximate to the fixed means, the first cross-sectional area being larger than the second cross-sectional area.

19. The apparatus of claim 18, further comprising:
means for storing a device attached to the second portion of the flexible element.

20. A method performed by a coiler comprising a fixed member, a rotating member, and a shaft having at least one tapered section such that the shaft has a first cross-sectional area proximate to the rotating member and a second cross-sectional area proximate to the fixed member, the first cross-sectional area being larger than the second cross-sectional area, the method comprising:
securing a first portion of a flexible element to the fixed member of the coiler;
rotating the rotating member of the coiler in a first direction around an axis of rotation as the fixed member and the shaft of the coiler remain relatively stationary, the shaft positioned between the fixed member and the rotating member;
passing a second portion of the flexible element through the rotating member; and
coiling the second portion of the flexible element around the shaft.

* * * * *